US006170582B1

(12) United States Patent
Singh et al.

(10) Patent No.: US 6,170,582 B1
(45) Date of Patent: Jan. 9, 2001

(54) ROCK BIT CONE RETENTION SYSTEM

(75) Inventors: Amardeep Singh, Houston; Steve Peterson, Woodlands; Sujian J. Huang, The Woodlands, all of TX (US)

(73) Assignee: Smith International, Inc., Houston, TX (US)

( * ) Notice: Under 35 U.S.C. 154(b), the term of this patent shall be extended for 0 days.

(21) Appl. No.: 09/346,642

(22) Filed: Jul. 1, 1999

(51) Int. Cl.[7] ..... E21B 10/20
(52) U.S. Cl. ..... 175/368; 384/96; 175/371
(58) Field of Search ..... 175/331, 371, 175/372, 337, 368; 384/96

(56) References Cited

U.S. PATENT DOCUMENTS 4,646,620 * 3/1987 Buchl ..... 91/1
4,646,858 * 3/1987 Strickland ..... 175/337
4,722,615 * 2/1988 Bailey et al. ..... 384/96
4,825,655 * 5/1989 Buchl et al. ..... 60/546
4,991,671 * 2/1991 Pearce et al. ..... 175/369
5,427,182 * 6/1995 Winter ..... 172/4 X
5,669,452 * 9/1997 Wright et al. ..... 172/685

* cited by examiner

*Primary Examiner*—William Neuder
(74) *Attorney, Agent, or Firm*—Rosenthal & Osha L.L.P.

(57) ABSTRACT

A roller cone drill bit includes a bit body adapted to be rotated about a longitudinal axis. At least one leg depends from the bit body, and a journal is cantilevered from the leg. A roller cone is rotatably mounted on the journal. A cone retention member is disposed between a first slot in the journal and a corresponding second slot in the roller cone. An access hole runs through the journal to the first slot, penetrating the first slot at a location away from the top dead center of the first slot.

18 Claims, 5 Drawing Sheets

ROCK BIT CONE RETENTION SYSTEM

BACKGROUND OF THE INVENTION

1. Technical Field

The invention relates generally to roller cone drill bits. More particularly, the invention relates to a system for retaining a roller cone on a bearing journal of the drill bit.

2. Background Art

Roller cone drill bits are generally made of a plurality of legs that are welded together to form a unitary structure. FIG. 1 shows an example of a drill bit leg 2 which defines a shirttail portion 4 and a cantilevered journal 6. The journal 6 forms a main bearing surface 8 for a roller cone 10. The roller cone 10 has cutting elements 12 which are adapted to deform earth formation as the drill bit leg 2 is rotated within a borehole. The roller cone 10 is retained on the journal 6 by a ball lock system which includes balls 16 that are retained between ball races 18 and 20 on the journal 6 and the roller cone 10, respectively. To assemble and lock the roller cone 10 to the journal 6, the balls 16 are inserted between the journal 6 and the roller cone 10 through a ball hole 22 which is drilled through the shirttail portion 4 and the journal 6. The ball hole 22 intersects the top dead center 24 of the ball race 18. The balls 16 are retained between the journal 6 and the roller cone 10 by welding a ball plug 25 in the shirttail side of the ball hole 22.

The drill bit leg thus described retains a roller cone on a journal using a ball lock system. However, there are other methods of retaining a roller cone on a journal, for example, segmented cone retention rings disposed in a slot on the journal and subsequently threadedly locked to the roller cone using a hole to gain access to a device which prevents rotation of the rings. Generally, any cone retention system that includes a hole penetrating a ball race or other slot on the journal will induce localized stresses in the ball race or slot. In particular, when the hole intersects a high stress region on the ball race, localized stresses which develop around the intersection of the ball race with the ball hole during operation of the drill bit may be sufficient to initiate cracks in the ball race and, possibly, break the journal. It would, however, be desirable to access the ball race or other slot on the journal without initiating cracks in the journal.

SUMMARY OF THE INVENTION

A roller cone drill bit comprises a bit body adapted to be rotated about a longitudinal axis. The bit body has at least one leg depending from it. A journal is cantilevered from the leg. A roller cone is rotatably mounted on the journal. A cone retention member is disposed between a first slot in the journal and a corresponding second slot in the roller cone. An access hole runs through the journal to the first slot. The access hole intersects the first slot at a location away from the top dead center of the first slot.

Other aspects and advantages of the invention will be apparent from the following description and the appended claims.

DESCRIPTION OF THE PREFERRED EMBODIMENTS

Figure 1:
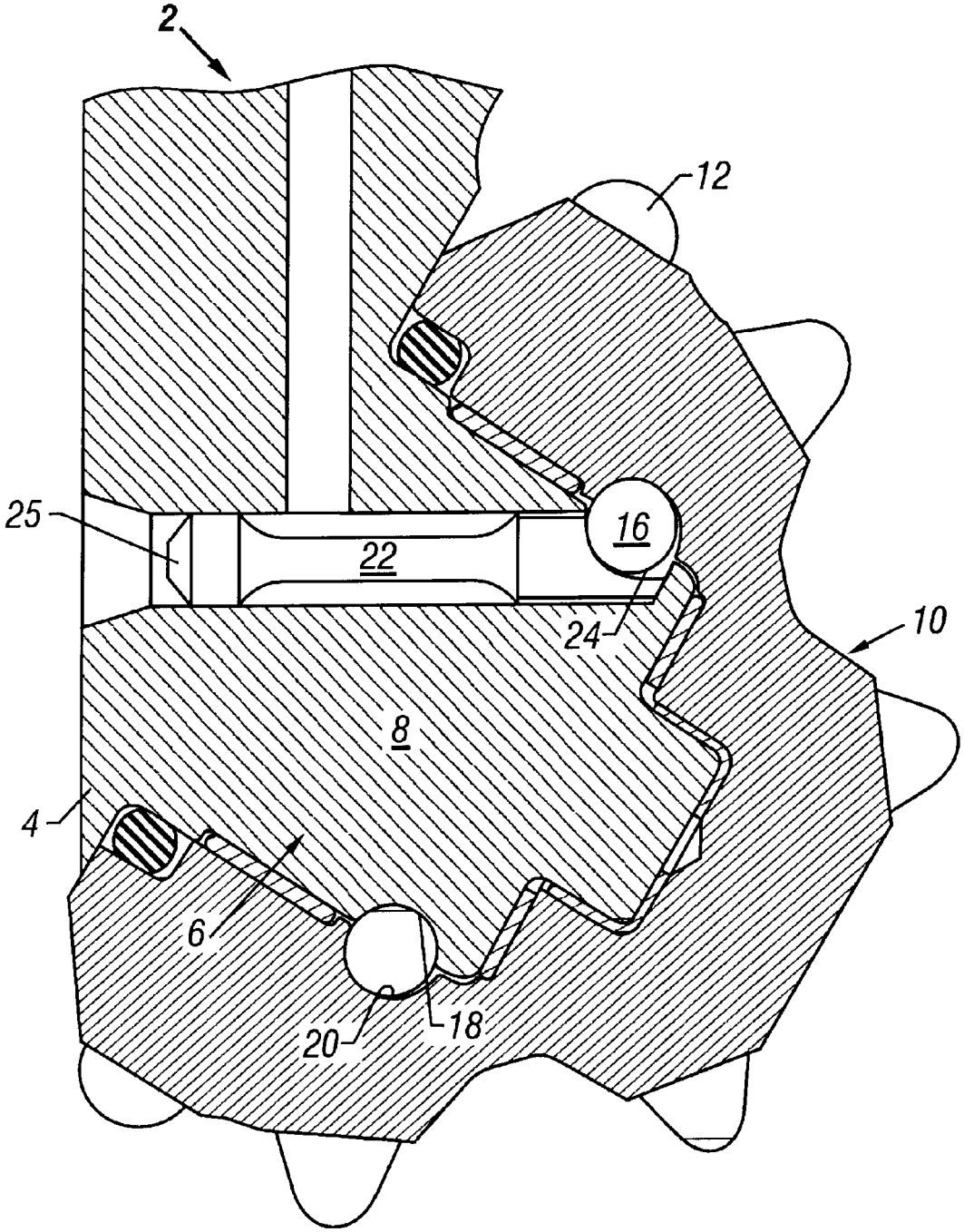
FIG. 1 (Prior Art)
FIG. 1 is a cross section of a prior art drill bit leg.
Figure 2:
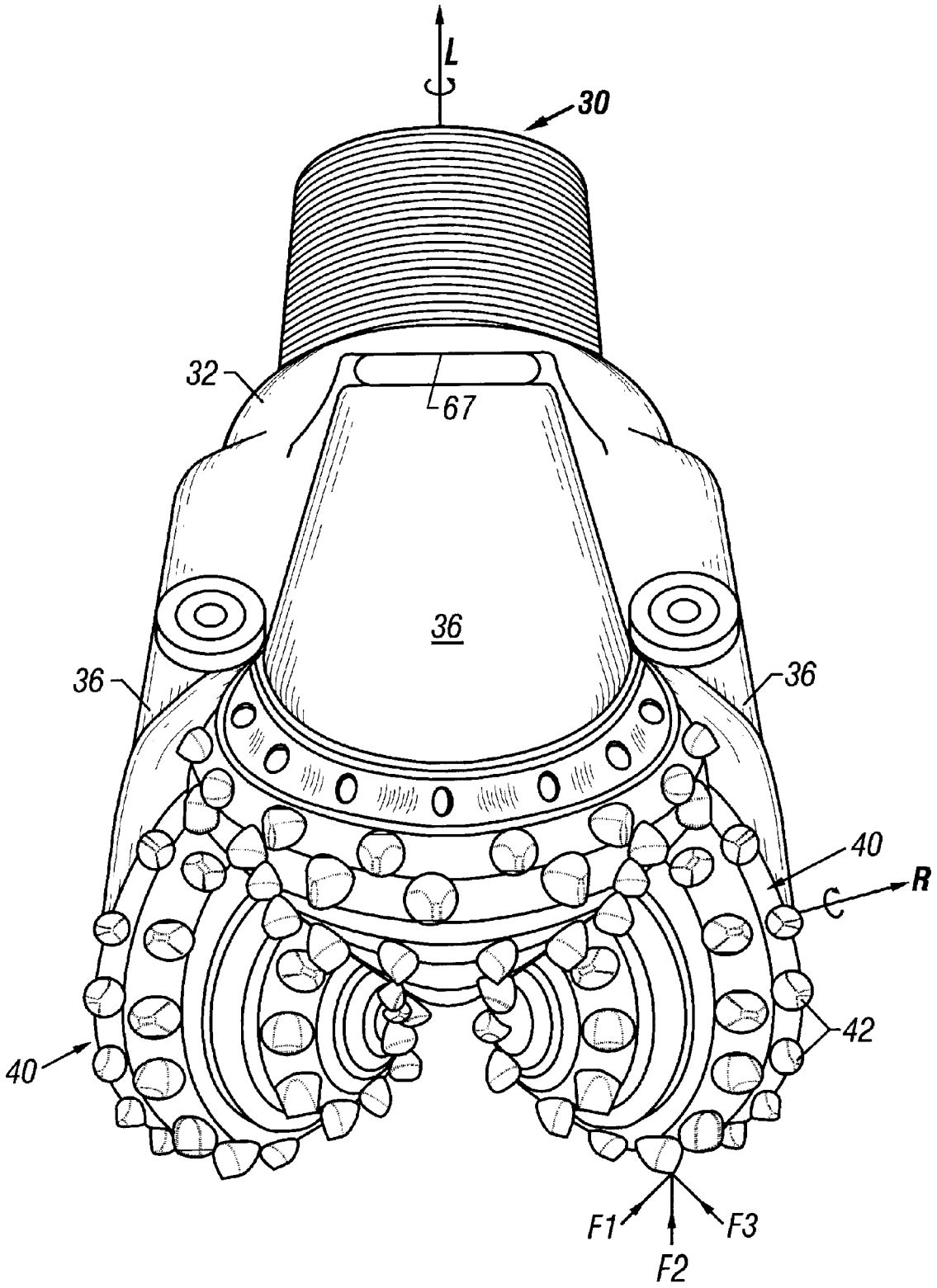
FIG. 2 shows a perspective view a roller cone drill bit.

FIG. 2 depicts a roller cone drill bit 30 which comprises a bit body 32 that is adapted to rotate about a longitudinal axis L. Three legs 36 extend downwardly from the bit body 32. The legs 36 are spaced 120 degrees apart along the circumference of the bit body 32. The upper end of the bit body 32 includes a threaded pin 38 which can be coupled to another tool, usually a drill string (not shown). A roller cone 40 is rotatably coupled to each leg 36. The roller cones 40 have cutting elements 42 which deform earth formation as the drill bit 30 is rotated about the longitudinal axis L. Although the drill bit 30 is shown as having three legs 36, it should be clear that the invention is equally applicable to a drill bit having only one leg or any other suitable number of legs. Also, the invention is independent of the type of cutting elements on the roller cones 40.

Figure 3:
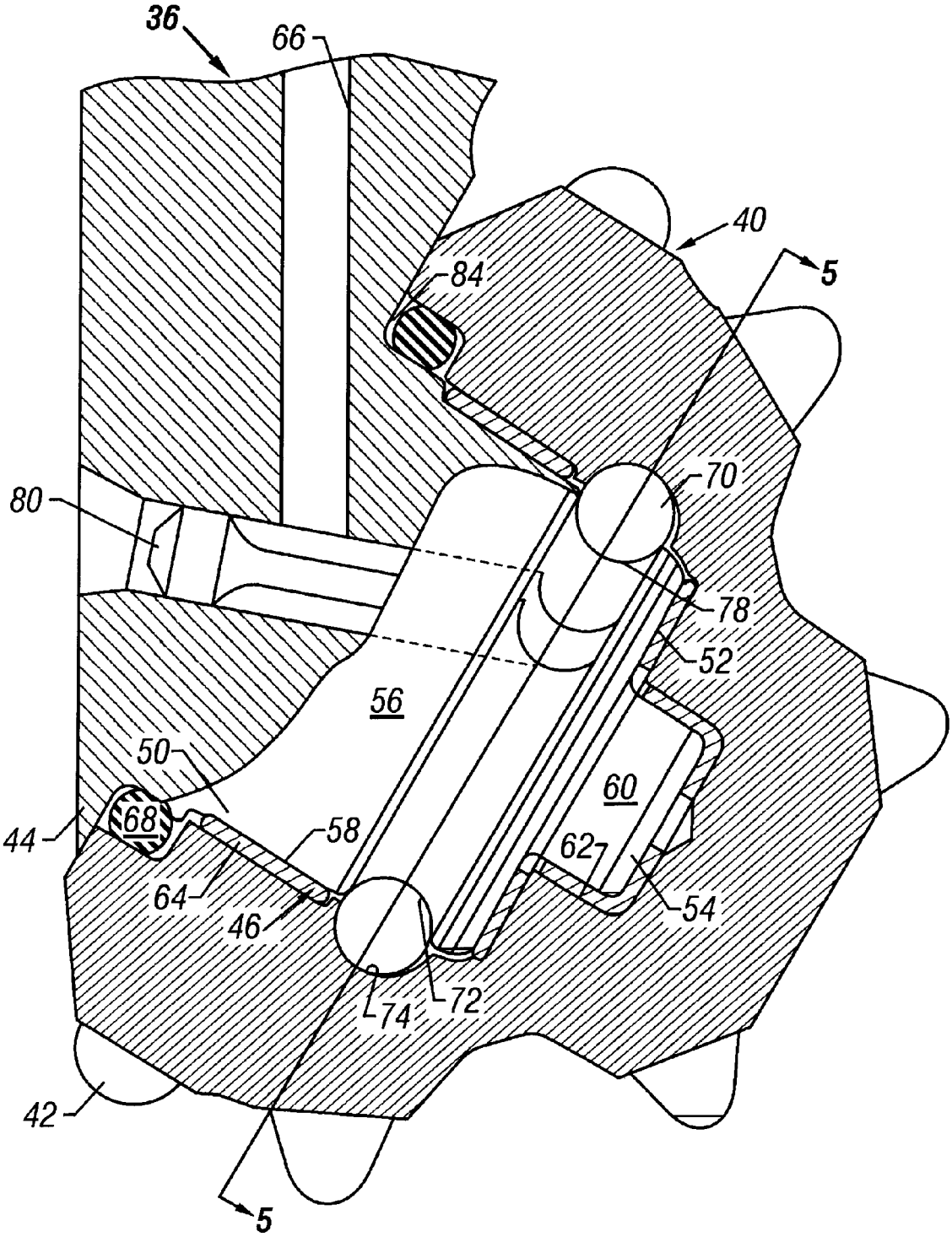
FIG. 3 is a cross section of one of the drill bit legs shown in FIG. 2.

FIG. 3 shows a partial cross section of one of the legs 36 shown in FIG. 2. The leg 36 terminates in a shirttail portion 44. A bearing pin 46 extends from the shirttail portion 44. The bearing pin 46 includes a journal 50, an axial thrust face 52, and a nose pin 54. The journal 50 forms a main bearing surface 56 for the roller cone 40. The roller cone 40 has a bearing surface 58 which provides a bearing for the main bearing surface 56. The nose 54 forms a bearing surface 60 which is retained within a complementary surface 62 within the roller cone 40. Lubricant is fed between the bearing surfaces 56 and 58 through one or more lubrication ports (not shown) in the journal 50 to minimize friction between the bearing surfaces. Friction between the bearing surfaces 56 and 58 may also be minimized by placing a low-friction bearing material, such as a low-friction pad 64, a roller bearing (not shown), a ball bearing (not shown), or other type of anti-friction bearing between the bearing surfaces. The lubrication ports (not shown) in the journal 50 communicate with a lubrication passage 66 which is connected to receive lubricant from a grease reservoir 67 (shown in FIG. 2) in the upper part of the leg 36. A seal 68 is provided to retain the lubricant between the bearing surfaces 56 and 58. However, it should be clear the invention is also applicable to non-sealed bearings.

Figure 4:
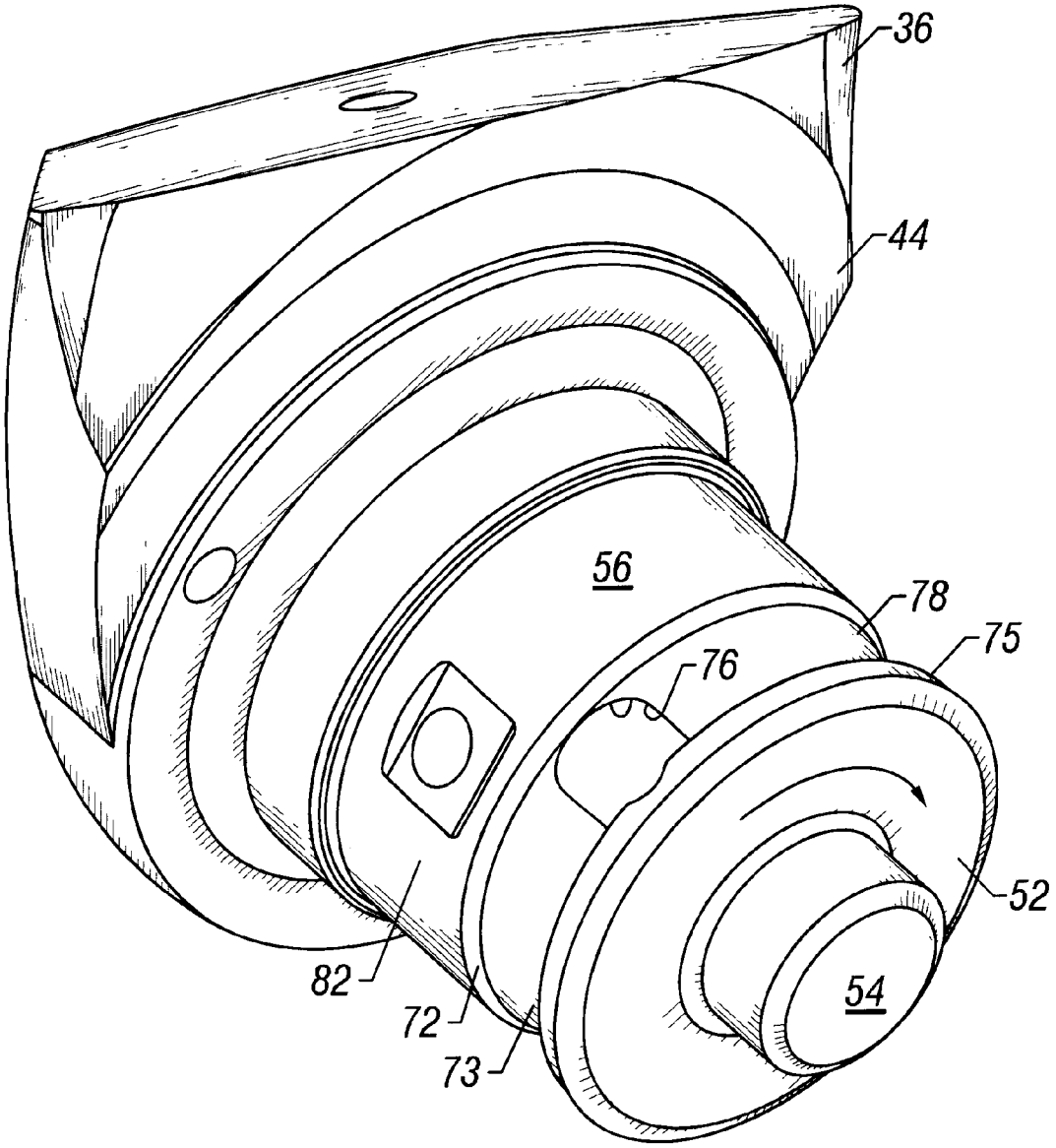
FIG. 4 shows a perspective view of the bearing pin shown in FIG. 3.

The roller cone 40 is retained on the journal 50 by balls 70. Ball races 72 and 74 are defined in the bearing surfaces 56 and 58 to hold the balls 70. The balls 70 are fed between the ball races 72 and 74 through a ball hole 76 that runs through the leg 36 and the journal 50 to the ball race 72. The balls 70 are retained between the ball races 72 and 74 by welding a ball plug 80 in the shirttail side of the leg 36. The ball hole 76 intersects the ball race 72 at a location away from the top dead center 78 of the ball race 72. The top dead center 78 is the uppermost point on the ball race 72 in the direction of the longitudinal axis L (shown in FIG. 2). Preferably, the ball hole 76 intersects the ball race 72 at an angle 2.5 degrees or more from the top dead center 78 of the ball race 72. Although the ball hole 76 is shown as a straight hole, it should be clear that the ball hole may comprise two or more non-parallel, intersecting holes. FIG. 4 shows a perspective view of the bearing pin 46 with the ball hole 76 intersecting the trailing side 73 of the ball race 72, i.e., the side of the ball race away from the rotational direction of the drill bit 30. The ball race 72 could also intersect the leading side of the ball race 72, i.e., the side of the ball race 72 facing the rotational direction of the drill bit 30.

Referring back to FIG. 2, when the drill bit 30 is rotated about the longitudinal axis L and forced against earth formation, a rotary motion is induced in each of the roller cones 40 about its respective rotational axis R. Typically, the rotational axis R of each roller cone 40 is offset a distance from the longitudinal axis L so that the cutting elements 42 can scrape earth formation in a direction inward of the drill bit 30. This inward scraping action of the cutting elements 42 results in a reaction force F1 from the earth formation to the roller cone 40 in the direction outward of the drill bit 30. Also, the earth formation applies a reaction force F2 to cutting elements 42 in the direction upward of the longitudinal axis L, which causes compressive loading on the bottom portion 82 (shown in FIG. 4) of the journal 50. In addition, as the drill bit 30 rotates about longitudinal axis L during drilling operation, most of the cutting elements 42 will scrape the formation in the direction of bit rotation, causing a reaction force F3 in circumferential direction against bit rotation.

Figure 5:
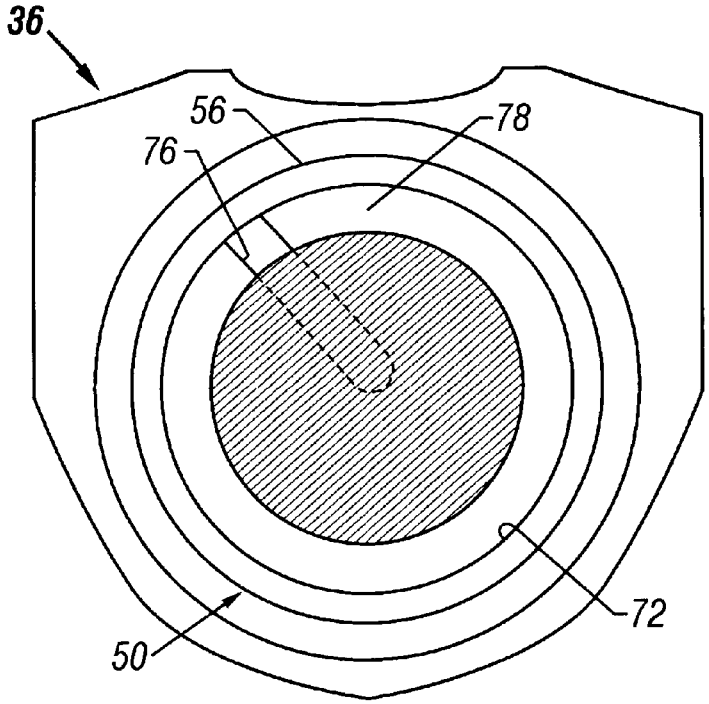
FIG. 5 is a cross section of the journal shown in FIG. 3 along lines A—A.

The reaction forces acting on the roller cone 40 are transmitted to the journal 50, making the top dead center 78 a high stress region. However, because the ball hole 76 intersects the ball race 72 in a location away from the top dead center 78, i.e., away from the high stress region, the probability of initiating cracks in the ball race 72 is reduced. Generally, the further away the ball hole 76 is from the top dead center 78, the lesser is the probability of initiating cracks in the ball race 72. To avoid compressive loading on the ball plug 80, it is desirable that the ball hole 76 intersects the ball race 72 in the upper half of the ball race 72, as illustrated in FIG. 5. The upper half of the ball race 72 in FIG. 5 is that part which is above line A—A'. Also, as a result of the forces acting on the ball race 72 during drilling operation, the leading side 75 of the ball race 72 has potential high stress. Thus, it is desirable that the ball hole 76 intersects the ball race 72 in the trailing side 73 of the ball race 72.

The invention is advantageous in that the probability of initiating cracks in the ball race 72 is substantially reduced when the ball hole 78 intersects the ball race 72 at a location away from the top dead center of the ball race. When the ball hole 76 intersects the ball race 72 at an angle of 45 degrees away from the top dead center 78, the highest stress on the ball race 72 drops by roughly 45 percent. When the ball hole 76 intersects the ball race at an angle of 90 degrees away from the top dead center 78, the highest stress on the ball race 72 drops by roughly 70 percent. In addition, the stress in the throat area 84 (shown in FIG. 3) of the leg 36, i.e., the juncture between the leg 36 and the journal 50, is reduced by roughly 10–20 percent when the ball hole intersects the ball race 72 at 90 degrees away from the top dead center 78. It is preferable that the ball hole 76 intersects the ball race 72 at an angle of at least 10 degrees from the top dead center 78 to provide meaningful reduction on stress about the ball hole 76. More preferably, the ball hole 76 intersects the ball race 72 at an angle of at least 25 degrees from the top dead center 78 to provide a substantial reduction in stress about the ball hole 76.

Figure 6:
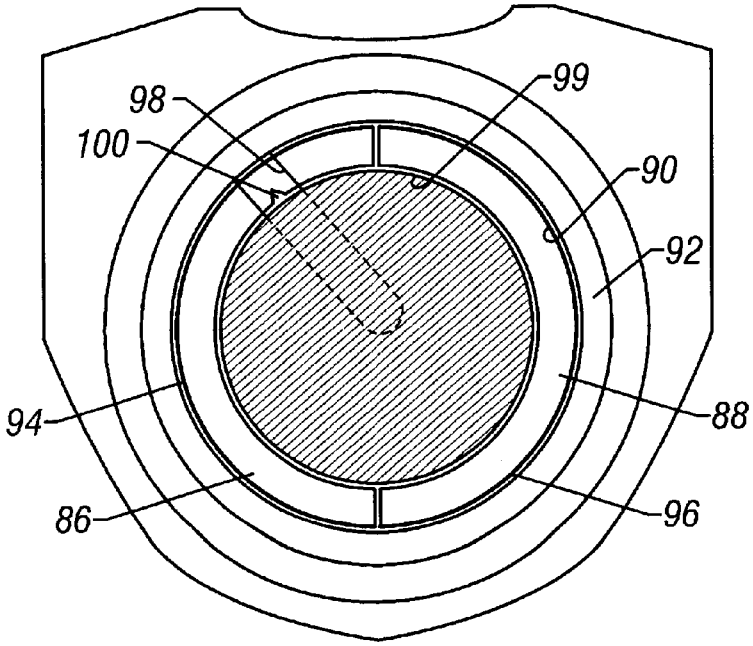
FIG. 6 shows threaded split rings for retaining a cone on a journal.

The invention has been described with respect to a drill bit which uses ball bearings to retain a roller cone on a journal. However, the invention is equally applicable to other types of cone retention systems. For example, FIG. 6 shows a cone retention system which includes split ring segments 86 and 88 that are disposed in a slot 90 on the bearing surface of a journal 92. The journal 92 is similar to the journal 50 shown in FIGS. 3–5, except that the slot 90 is designed to accept the split ring segments 86 and 88 instead of a series of ball bearings. The outer surfaces 94 and 96 of the split segments 86 and 88 include threads which are adapted to interlock with a similar threaded surface on the inner surface of a roller cone (not shown).

To assemble the drill bit, the split ring segments 86 and 88 are arranged in the slot 90 of the journal 92, as illustrated in FIG. 6. Then a tool (not shown) is inserted through an access hole 98, similar to the ball hole 76 (shown in FIGS. 3–5), into the slot 100 in the split segment 86. The tool locks the split ring segments 86 and 88 down, allowing the roller cone to be slipped over the journal 92 and turned to threadedly engage the split segments 86 and 88. The access hole 98 is located away from the top dead center 99 of the slot 90 as previously disclosed for the ball hole 76 in FIGS. 3–5.

It will be apparent to those skilled in the art that the foregoing description is only an example of the invention, and that other embodiments of the invention can be devised which will not depart from the spirit of the invention as disclosed herein. Accordingly, the invention shall be limited in scope only by the attached claims.

What is claimed is:

1. A roller cone drill bit comprising:

a bit body adapted to be rotated about a longitudinal axis, the bit body having at least one leg depending therefrom;

a journal cantilevered from the leg;

a roller cone rotatably mounted on the journal;

a cone retention member disposed between a first slot in the journal and a corresponding second slot in the roller cone; and an access hole running through the journal to the first slot, the access hole penetrating the first slot at a location away from a top dead center of the first slot.

2. The roller cone drill bit of claim 1, wherein the access hole intersects the first slot in the upper half of the slot.

3. The roller cone drill bit of claim 2, wherein the access hole intersects the first slot on the trailing side of the first slot.

4. The roller cone drill bit of claim 1, wherein the access hole intersects the first slot on the trailing side of the first slot.

5. The roller cone drill bit of claim 1, wherein the cone retention member comprises ball bearings.

6. The roller cone drill bit of claim 1, wherein the cone retention member comprises threaded rings.

7. The roller cone drill bit of claim 1, wherein the access hole intersects the first slot at least 10 degrees away from the top dead center of the first slot.

8. The roller cone drill bit of claim 7, wherein the access hole intersects the first slot on the trailing side of the first slot.

9. The roller cone drill bit of claim 7, wherein the access hole intersects the first slot in the upper half of the slot.

10. The roller cone drill bit of claim 9, wherein the access hole intersects the first slot on the trailing si d e of t he first slot.

11. The roller cone drill bit of claim 7, wherein the cone retention member comprises ball bearings.

12. The roller cone drill bit of claim 7, wherein the cone retention member comprises threaded rings.

13. The roller cone drill bit of claim 7, wherein the access hole intersects the first slot at least 25 degrees away from the top dead center of the first slot.

14. The roller cone drill bit of claim 13, wherein the access hole intersects the first slot in the upper half of the first slot.

15. The roller cone drill bit of claim 14, wherein the access hole intersects the first slot on the trailing side of the first slot.

16. The roller cone drill bit of claim 13, wherein the access hole intersects the first slot on the trailing side of the first slot.

17. The roller cone drill bit of claim 13, wherein the cone retention member comprises ball bearings.

18. The roller cone drill bit of claim 13, wherein the cone retention member comprises threaded rings.

* * * * *